US008397689B2

(12) United States Patent
Baker et al.

(10) Patent No.: US 8,397,689 B2
(45) Date of Patent: Mar. 19, 2013

(54) FUEL PUMP TAPPET/ROLLER FOLLOWER LUBRICATION

(75) Inventors: Rodney E. Baker, Fenton, MI (US); James B. Hicks, Shelby Township, MI (US); Brian W. Geiser, Ortonville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 333 days.

(21) Appl. No.: 12/841,255

(22) Filed: Jul. 22, 2010

(65) Prior Publication Data

US 2011/0277714 A1 Nov. 17, 2011

Related U.S. Application Data

(60) Provisional application No. 61/345,405, filed on May 17, 2010.

(51) Int. Cl.
*F01L 1/14* (2006.01)

(52) U.S. Cl. ..... 123/90.48; 123/90.52; 123/90.33

(58) Field of Classification Search ..... 123/90.48, 123/90.52, 90.33
See application file for complete search history.

(56) References Cited

FOREIGN PATENT DOCUMENTS

| | | | |
|---|---|---|---|
| DE | 60123861 | T2 | 2/2007 |
| DE | 60316740 | T2 | 7/2008 |
| JP | 2007192134 | A * | 8/2007 |

OTHER PUBLICATIONS

Abstract of JP 2007192134 A.*

* cited by examiner

*Primary Examiner* — Zelalem Eshete
(74) *Attorney, Agent, or Firm* — Quinn Law Group, PLLC

(57) ABSTRACT

A cylinder head including a dam defining a reservoir surrounding the periphery of the fuel pump tappet/roller follower mounting hole is provided. The cylinder head includes a tappet/roller follower mounted in the tappet/roller follower mounting hole and in communication with a cam and a fuel pump. The fuel pump is located on the high side of the head and oil drainage occurs in a direction away from the mounting hole. The dam and reservoir are configured to retain lubricant in the mounting hole and the sliding interface between the mounting hole and the tappet/roller follower. The dam and reservoir are configured to retain a minimum level of oil in the mounting hole when the head is in vehicle position. A method is provided for retaining lubrication in the tappet/roller follower hole by forming a dam defining a reservoir in the head and passively providing lubricant to the tappet/roller follower hole.

13 Claims, 4 Drawing Sheets

FUEL PUMP TAPPET/ROLLER FOLLOWER LUBRICATION

CROSS-REFERENCE TO RELATED APPLICATIONS

This application claims the benefit of U.S. Provisional Patent Application No. 61/345,405 filed May 17, 2010, and which is hereby incorporated by reference in its entirety.

TECHNICAL FIELD

The present invention relates to lubrication of a fuel pump tappet/roller follower, and specifically to lubrication of a fuel pump tappet/roller follower mounted in a cylinder head.

BACKGROUND

The fuel pump is typically mounted on the low side of an engine cylinder head such that oil pooling on the low side of the cylinder head is available to accumulate in the fuel pump tappet/roller follower mounting hole, thereby passively providing a source of lubrication to the fuel pump tappet/roller follower mounting hole and ensuring that oil is provided to the tappet/roller follower and to the sliding interface between cylinder head surface and the fuel pump tappet/roller follower. When engine packaging constraints exist which prohibit locating the fuel pump on the low side of the engine or require mounting the fuel pump in an engine location where oil drains away from or otherwise is not adequately provided to the tappet/roller follower sliding interface, alternative methods must be used to ensure a supply of oil lubricate the interface. For example, pressurized oil can be provided to the interface, which would require routing of oil to the fuel pump tappet/roller follower mounting hole, increasing demand from the oil pump and increasing the cost of the cylinder head. Providing pressurized oil may also result in excess oil pooling around the tappet/roller follower and creating the potential for hydraulic locking.

SUMMARY

A cylinder head including a dam defining a reservoir surrounding all or a portion of the periphery of the tappet/roller follower mounting hole is provided herein. The cylinder head is configured for installation on an engine, where the engine is oriented in the vehicle such that it is tilted off horizontal around its longitudinal axis, defining a high side and a low side of the cylinder head. The cylinder head includes a tappet/roller follower mounted in the tappet/roller follower mounting hole and in communication with a cam and a fuel pump. The fuel pump is located on the high side of the cylinder head, such that oil drainage due to gravity will occur in a direction away from the fuel pump and fuel pump tappet/roller follower mounting hole. The dam and reservoir are configured to retain lubricant in the tappet/roller follower mounting hole and in the sliding interface between the mounting hole and the tappet/roller follower. The dam and reservoir are further configured to retain a minimum level of oil in the tappet/roller follower mounting hole when the cylinder head is oriented as installed on the engine in vehicle position.

A method for providing lubrication to the fuel pump tappet/roller follower hole in the cylinder head is provided, which includes forming the dam defining the reservoir in the cylinder head, providing lubricant to the tappet/roller follower hole, and retaining lubricant in the reservoir such that lubricant is retained in the tappet/roller follower hole and provided to a sliding interface between a tappet/roller follower and a tappet/roller follower hole surface. Lubricant may be passively provided to the tappet/roller follower hole by directing oil from an adjacent cam bearing onto the tappet/roller follower such that the oil directed onto the tappet/roller follower flows into one of the tappet/roller follower hole and reservoir.

The above features and other features and advantages of the present invention are readily apparent from the following detailed description of the best modes for carrying out the invention when taken in connection with the accompanying drawings.

DETAILED DESCRIPTION

When packaging constraints or other engine design considerations require that the fuel pump cannot be located on the cylinder head such that passive oil flow or pooling oil in the head provides adequate lubrication to the fuel pump tappet/roller follower, an alternative means to ensure adequate lubrication of the fuel pump tappet/roller follower and tappet/roller follower sliding interfaces must be provided. In an illustrative example, a fuel pump is mounted on the high side of a cylinder head with the fuel pump tappet/roller follower oriented such that oil circulating in the cylinder head drains from the high side of the cylinder head to the low side of the cylinder head and away from the fuel pump and fuel pump tappet/roller follower. A cylinder head including an integrated oil reservoir configured to retain and passively supply lubricant to the tappet/roller follower mounting hole and the sliding interfaces of the tappet/roller follower is provided herein. Oil retained in the reservoir and mounting hole is accumulated from oil directed from an adjacent cam bearing onto the tappet/roller follower in adequate supply to lubricate the tappet/roller follower interfaces. Excess oil is released from the reservoir over the reservoir dam to minimize potential for hydraulic locking of the tappet/roller follower. The oil reservoir precludes the need to provide pressurized oil to the fuel pump tappet/roller follower and thereby precludes increased oil demand from the engine oiling system. By providing the dam and reservoir at minimal cost and as a means to passively lubricate the fuel pump tappet/roller follower and mounting hole, additional packaging options and fuel pump mounting locations on the cylinder head become feasible. The integrated oil reservoir provides the advantages of increased flexibility and alternatives in the design, configuration and packaging of the fuel pump, cylinder head and engine.

Figure 1:
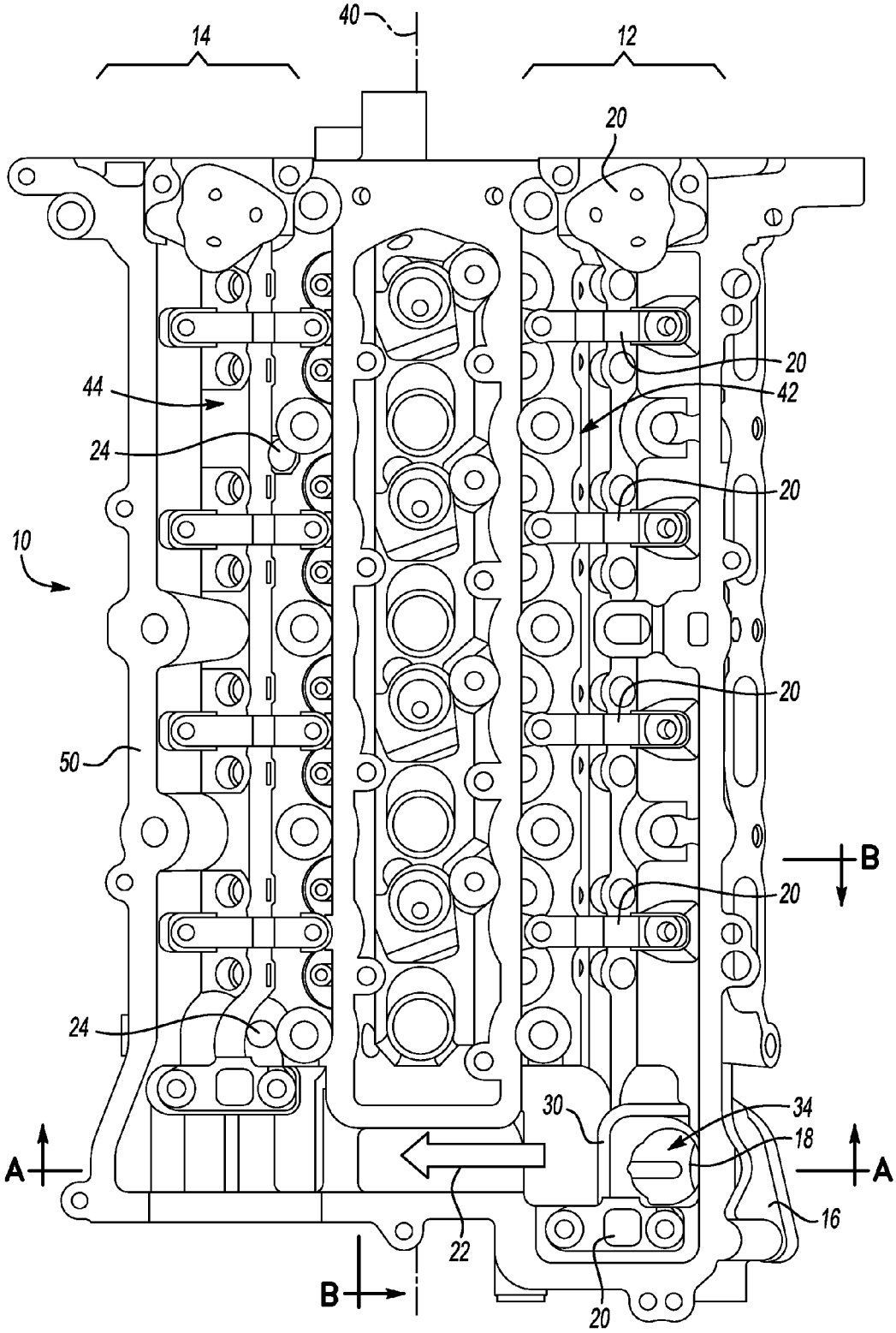
FIG. 1 is a schematic top view of a cylinder head with a fuel pump tappet/roller follower mounting hole.

Referring to the drawings wherein like reference numbers represent like components throughout the several figures, and beginning with FIG. 1, a schematic top view of a partially assembled cylinder head is generally indicated at 10, including a cylinder head body 50 and a plurality of bearing caps 20. Cylinder head body 50 is typically formed as a casting and may be finished by machining. Cylinder head 10, which may also be referred to as head 10, is configured to include a first side 12 and a second side 14, which are generally oriented along either side of the longitudinal axis 40 of head 10. A first chamber 42 is defined by first side 12 of head 10 and a second chamber 44 is defined by second side 14 of head 10. In the configuration shown in FIG. 1, first side 12 is the intake side of head 10 and first chamber 42 is the intake chamber of head 10; and second side 14 is the exhaust side of head 10 and second chamber 44 is the exhaust chamber of head 10.

A fuel pump boss 16 is shown in FIG. 1 and is located on intake side 12 of head 10. Boss 16, which may also be referred to as a fuel pump locating surface or fuel pump mounting surface, is configured for assembling or mounting a fuel pump (not shown) on cylinder head 10, such that the fuel pump actuating mechanism, for example, the fuel pump plunger, is located in an orifice 18 and oriented to operatively communicate with a fuel pump tappet/roller follower (not shown). Bearing caps 20 on intake side 12 retain a cam shaft (not shown) including a cam (not shown) which is in operative communication with the fuel pump tappet/roller follower.

Orifice 18 is configured to provide a surface 34 which interfaces with the fuel pump tappet/roller follower, such that the tappet/roller follower, when mounted in orifice 18, is disposed between the cam and the fuel pump plunger. When a force is exerted on the tappet/roller follower from either the cam rotating against the cam end of the tappet/roller follower or from a spring exerting a force on the opposite end of the tappet/roller follower and resisting the cam, the body of the tappet/roller follower slides in contact with surface 34 of orifice 18. The tappet/roller follower may be configured as a tappet, roller tappet, a roller follower, a flat tappet or of other configuration suitable to transfer force from the cam to the fuel pump plunger. The tappet/roller follower may also be referred to or configured as a tappet, a roller follower, or a roller tappet. Orifice 18 may be referred to as a mounting hole, a tappet hole, or a tappet/roller follower hole. Surface 34 of tappet hole 18 may be referred to as an interface surface, a hole surface, a bore surface, a tappet bore or a tappet/roller follower bore.

Figure 2:
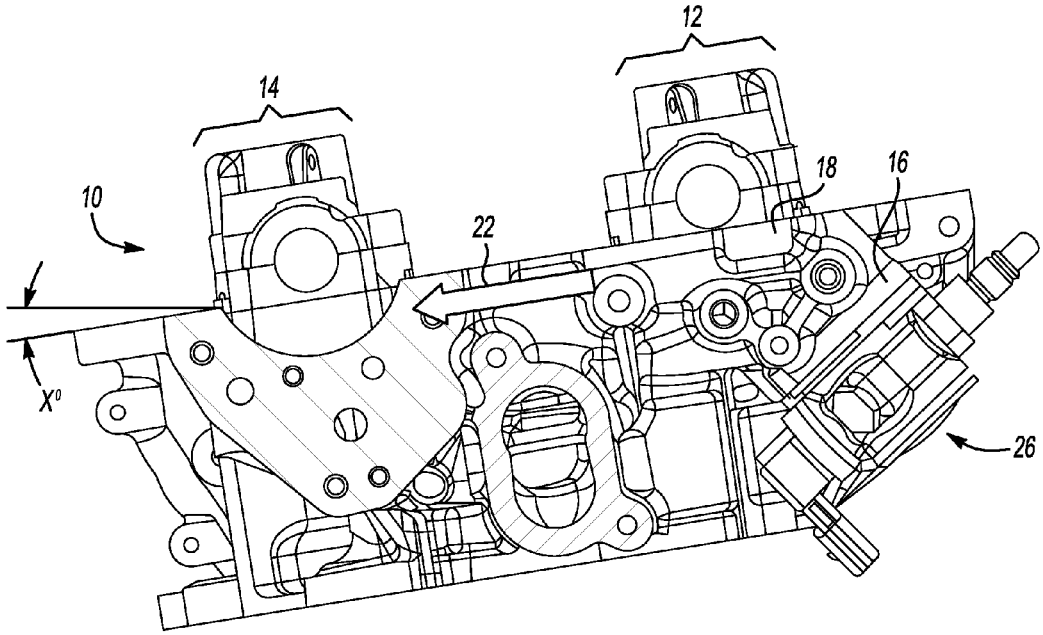
FIG. 2 is a cross-sectional view of section A-A of FIG. 1 showing the orientation of the cylinder head as installed in a vehicle, with the fuel pump and tappet/roller follower mounting hole located on the high side of the cylinder head.

To minimize wear and for smoothness of operation, lubrication must be provided to the tappet/roller follower and tappet/roller follower interfaces, including the tappet/roller follower interface with the cam, the fuel pump plunger, and tappet bore 34. The lubricant or lubricating fluid is typically, for example, motor oil or a synthetic or semi-synthetic lubricant or oil. In the example illustrated herein, oil present in the cylinder head flows, due to gravity, in a direction 22 from intake side 12 toward exhaust side 14, and from intake chamber 42 to exhaust chamber 44, where the oil may pool in exhaust chamber 44 or drain through oil drain holes 24. The oil flows in a direction 22 due to the orientation of cylinder head 10 when installed in an engine, e.g., cylinder head 10 is tilted off horizontal in an installed position, as shown in FIG. 2. Therefore, unconstrained oil flowing in direction 22 generally flows away from the fuel pump tappet mounting hole 18. A dam 30 has been integrated into head 10 to retain oil in tappet hole 18 up to a specified depth or level to ensure adequate lubrication is provided to the tappet/roller follower and sliding interface. Further, dam 30 allows oil accumulating above a specified depth or level in hole 18 to drain over dam 30 and away from hole 18, to prevent pooling of excess oil or hydraulic locking of the tappet/roller follower.

Referring now to FIG. 2, the orientation of cylinder head 10 when installed in an engine in a vehicle is shown in additional detail. FIG. 2 shows a cross-sectional view of section A-A of FIG. 1, with cylinder head 10 in an installed orientation. When installed in an engine in a vehicle, head 10 is oriented such that head 10 is tilted or rotated about its longitudinal axis 40 (see FIG. 1) by X degrees off horizontal, and such that intake side 12 is higher than exhaust side 14. In this orientation, intake side 12 is referred to as the high side of head 10, and exhaust side 14 is referred to as the low side, where high side 12 is tilted X degrees above horizontal and low side 12 is tilted X degrees below horizontal. In an installed configuration on an engine and in a vehicle, the horizontal plane can be defined as a plane parallel with the plane established by the wheels of the vehicle in contact with the ground upon which the vehicle sits in a normal orientation. Fuel pump 26 is shown installed on boss 16 on high side 12 of head 10, such that the fuel pump plunger 28 is oriented in orifice 18 for communication with the tappet/roller follower. FIG. 2 shows the direction 22 of the flow of oil in head 10 due to gravity in an installed orientation, from high side 12 to low side 14 and away from fuel pump 26 and tappet hole 18.

Figure 3:
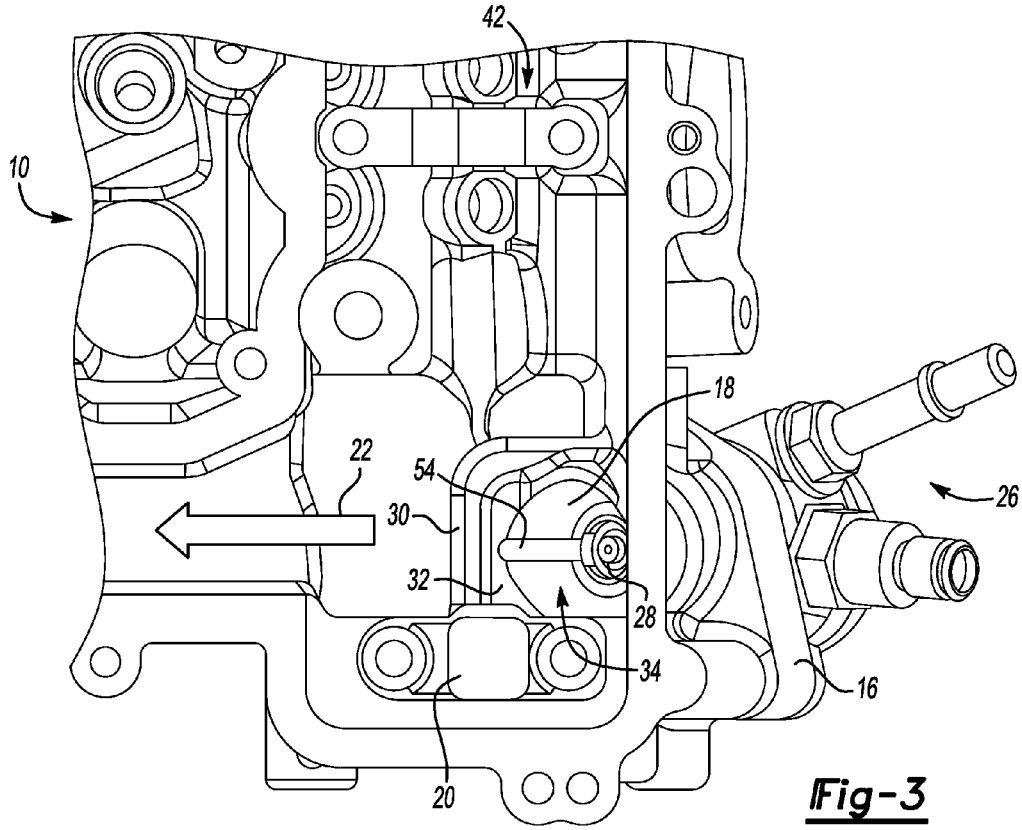
FIG. 3 is a partial sectional schematic view of section B-B of FIG. 1, showing the drainage path of oil from the fuel pump tappet/roller follower mounting hole when the cylinder head is oriented as installed in a vehicle.
Figure 4:
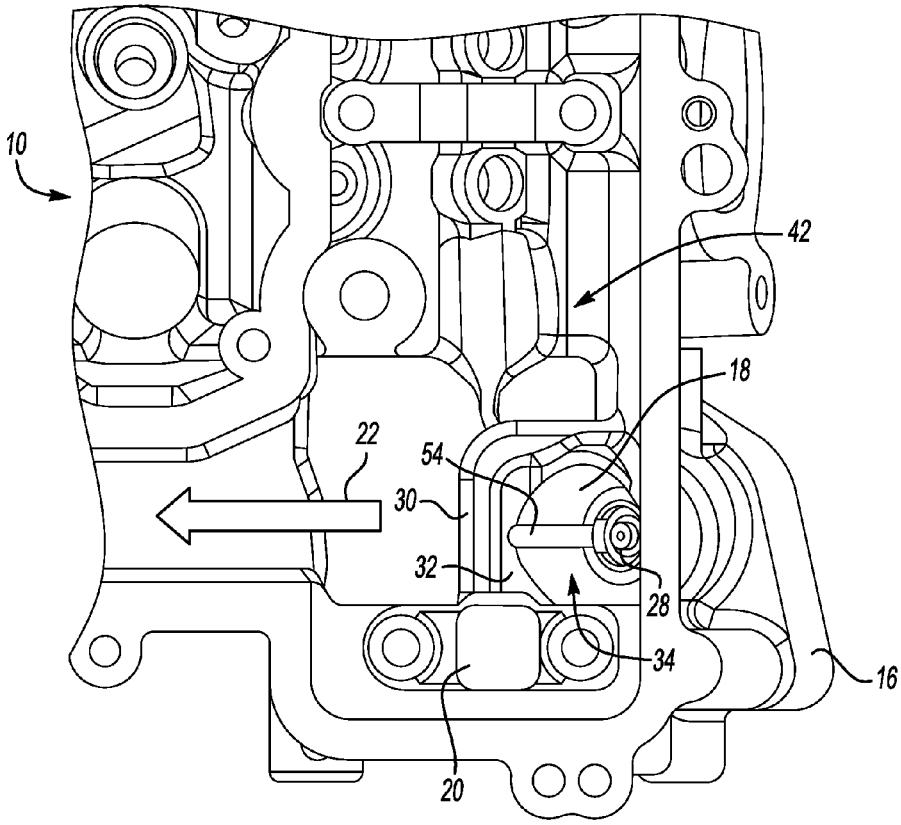
FIG. 4 is a partial sectional schematic view of section B-B of FIG. 1, showing the oil dam and oil reservoir surrounding the fuel pump tappet/roller follower mounting hole.

Referring now to FIGS. 3 and 4, a top view of section B-B of FIG. 1 is shown. Fuel pump tappet mounting hole 18 and cylinder head 10 are oriented as installed in a vehicle, with oil drainage due to gravity occurring generally in a direction 22. FIG. 3 shows fuel pump 26 mounted on boss 16 such that the fuel pump plunger mechanism 28 is located in tappet/roller follower hole 18. Tappet/roller follower hole 18 may be configured with an orientation or registration feature, such as a slot 54, which may be used to orient plunger mechanism 28 in tappet hole 18 for alignment of the plunger with the tappet/roller follower. Slot 54 may also be used to orient the tappet/roller follower to plunger 28, and to guide the tappet/roller follower as it slidably interfaces with surface 34 of hole 18 during operation. For example, the body of the tappet/roller follower may include a feature such as a nub or key which conforms with slot 54 to orient the tappet/roller follower and to guide the sliding movement of the tappet/roller follower in hole 18 during operation.

Oil dam 30 defining an oil reservoir 32 is shown in FIGS. 3 and 4. Oil dam 30 and reservoir 32 are configured to at least partially surround fuel pump tappet mounting hole 18 to retain oil in tappet/roller follower hole 18 and reservoir 32, and to prevent drainage of oil away from and out of tappet/roller follower hole 18. Oil may be passively provided to the reservoir 32 and tappet/roller follower hole from, for example, oil directed from the cam bearing and bearing cap 20 which is located adjacent to hole 18 toward the tappet/roller follower during operation of the cylinder head.

Figure 5:
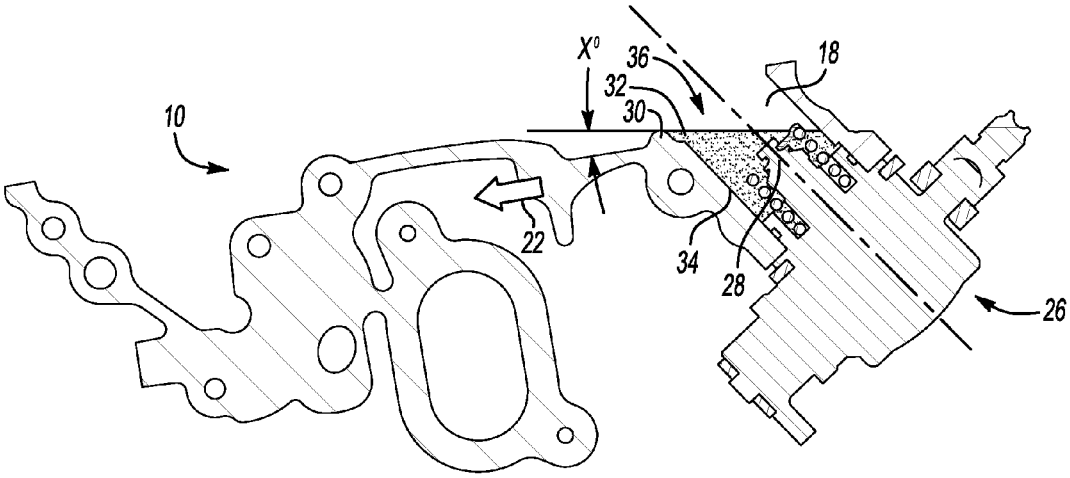
FIG. 5 is a schematic partial cross-sectional illustration of section A-A of FIG. 1 illustrating the oil level in the reservoir and fuel pump tappet/roller follower mounting hole when the cylinder head is oriented as installed in a vehicle.

Referring now to FIG. 5, a cross-sectional illustration of section A-A of FIG. 1 illustrates oil 36 retained by dam 30 in reservoir 32 and tappet hole 18 when cylinder head 10 including fuel pump 26 is oriented as installed in a vehicle. As shown, the level of oil accumulated in and retained by dam 30 in tappet hole 18 and reservoir 32 is adequate to provide lubrication to the tappet/roller follower and to the sliding interface between the tappet/roller follower body and hole surface 34. Oil accumulating above the oil level shown in FIG. 5 flows out of reservoir 32 over dam 30, typically in an oil drainage direction 22, thus preventing excess accumulation of oil around the tappet/roller follower and thereby reducing the potential for hydraulic lock. Additional drainage, if required, may be provided by an auxiliary drainage passage or hole (not shown) which may be located, for example, behind the tappet/roller follower spring.

Figure 6:
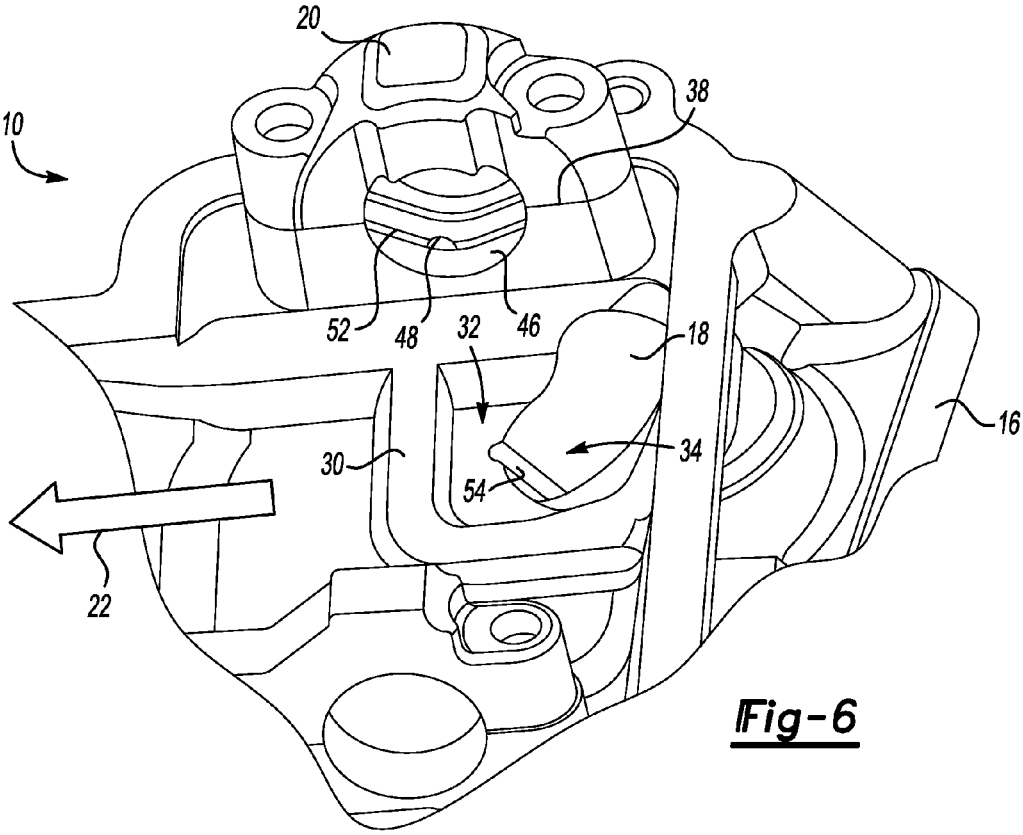
FIG. 6 is a partial sectional perspective schematic view the mounting hole and oil dam and reservoir of the cylinder head of FIG. 1 in relationship with the adjacent cam shaft bearing.

FIG. 6 shows mounting hole 18, oil dam 30 and reservoir 32 in additional detail and in relationship with adjacent cam shaft bearing 46 and cam bearing cap 20. Oil is provided to bearing 46 through an oil hole 48, and flows through oil grooves 52 into and through a T-slot 38 in the mounting face of cap 20 to be distributed on the cam and tappet/roller follower and into one or both of hole 18 and reservoir 32. Oil accumulates in tappet hole 18 and in reservoir 32 to provide adequate lubrication to the sliding interface between hole surface 34 including guide slot 54 and the tappet/roller follower. Dam 30 retains the oil in reservoir 32 up to a depth or level determined by the height of the dam, and allows for drainage of excess oil over dam 30 in an oil drainage direction 22. Dam 30 defining reservoir 32 is an integrated feature of cylinder head 10 and may be, for example, formed during casting of head 10 at minimal or no additional cost. As shown, dam 30 is configured as a cast rib with tapered sides and is of a general L-shape or C-shape. Dam 30 extends at least partially around the periphery of hole 18 from one chamber wall to another chamber wall, so as to surround hole 18 along the perimeter portion of hole 18 from which oil will drain when head 10 is in an as installed orientation.

Figure 7:
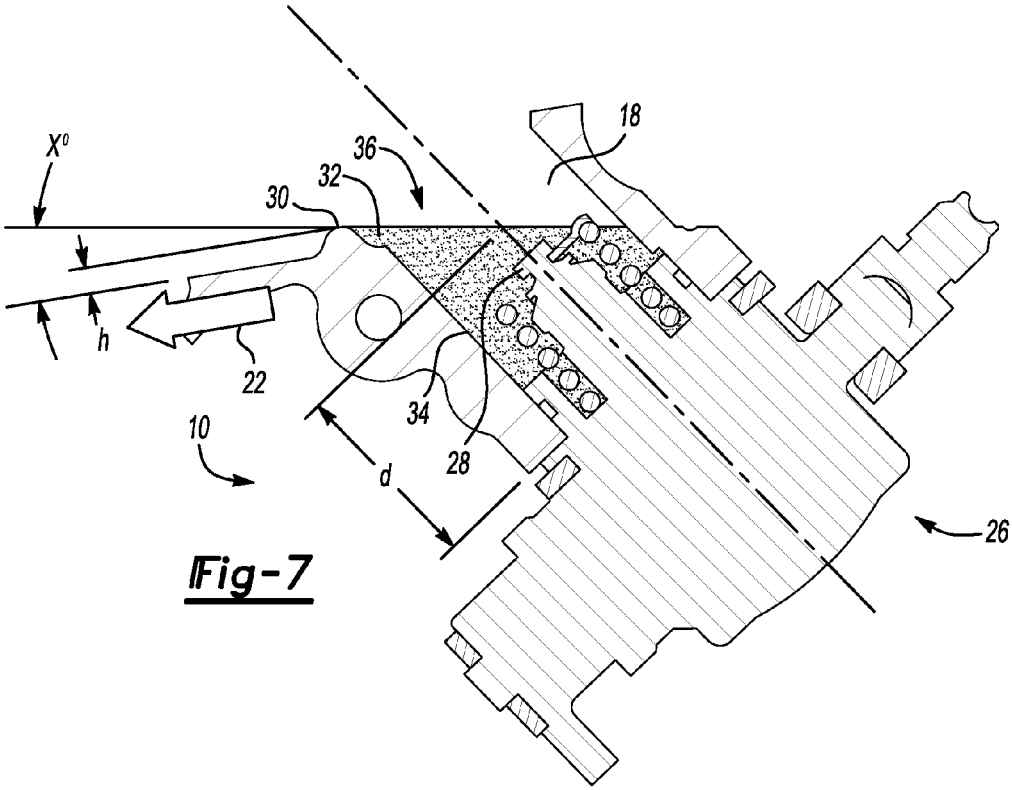
FIG. 7 is a partial view of the schematic illustration of FIG. 5 showing the relationship between cylinder head orientation, dam height and oil level.

Referring now to FIG. 7, a partial view of the schematic illustration of FIG. 5 is shown to illustrate the relationship between the orientation of cylinder head 10, the height of dam 30 and level of oil retained in hole 18 and reservoir 32, which may also be described by the depth of oil at the midline or along the axis of hole 18. As discussed previously for FIG. 5, oil 36 is retained by dam 30 in hole 18 and reservoir 32 at a sufficient depth d in hole 18, where depth d corresponds to the level of oil specified to maintain an adequate oil supply to the tappet/roller follower and sliding interface. Oil accumulated in excess of a depth d drains over dam 30 to prevent excessive pooling and hydraulic locking of the tappet/roller follower. The height h of dam 30 is directly related to and controls the depth d of oil in hole 18. As shown in FIG. 7, for a given dam height h, the depth d of oil retained in hole 18 by dam 30 will vary as the tilt angle X of cylinder head 10 in an installed orientation is varied. Therefore, when designing cylinder head 10, height h must be determined considering the specific configuration of cylinder head 10, its components and drainage paths, and further considering the orientation and tilt angle of head 10 in an installed position in a vehicle.

The configuration of dam 30 and reservoir 32 is not limited to the examples illustrated by the figures shown herein, and may be varied as required by cylinder head design and functional requirements, which may include, for example, engine packaging constraints, fuel pump placement on the cylinder head, configuration of tappet hole 18, location of the oil source providing oil to the tappet/roller follower and tappet/roller follower hole 18, one or more drainage paths 22 defined by the configuration of the head chambers and the as installed orientation of head 10, the interface configuration of the tappet/roller follower, cam and fuel pump and the configuration of the sliding interface. The size and shape of reservoir 32 may also be varied to provide the required volume and depth of oil in tappet/roller follower hole 18 and to ensure adequate lubrication of the tappet/roller follower and sliding interface 34, as discussed for FIG. 7. The shape, height, width and cross-section of dam 30 may vary according to design and functional requirements. Dam 30 and reservoir 32 may be integrally formed in cylinder body 50 by casting, machining or a combination thereof, or by adding or affixing additional material or components to head 10 to define dam 30 and/or reservoir 32.

While the best modes for carrying out the invention have been described in detail, those familiar with the art to which this invention relates will recognize various alternative designs and embodiments for practicing the invention within the scope of the appended claims.

The invention claimed is:

1. A cylinder head configured to include a tappet/roller follower in communication with a cam and a fuel pump and configured for installation on an engine, the cylinder head comprising:

a cylinder head body including a surface defining a tappet/roller follower mounting hole;

an interface surface defined by portion of the surface of the cylinder head body defining the mounting hole;

wherein the interface surface and the tappet/roller follower define a sliding interface;

a dam defining a reservoir;

wherein the dam and reservoir are configured to retain lubricant in the tappet/roller follower mounting hole and in the sliding interface; and a drainage passage defined by the cylinder head body and interface surface, wherein the drainage passage is configured to drain lubricant from the tappet/roller follower mounting hole.

2. The cylinder head of claim 1, wherein the dam and reservoir are configured to retain a minimum level of lubricant in the tappet/roller follower mounting hole when the cylinder head is oriented as installed on the engine in vehicle position.

3. The cylinder head of claim 1, wherein the dam and reservoir are defined by the cylinder head casting.

4. The cylinder head of claim 1, wherein the dam partially surrounds the periphery of the mounting hole.

5. The cylinder head of claim 3, wherein the dam is generally configured as one of an L-shape and a C-shape.

6. The cylinder head of claim 1, wherein the minimum level of lubricant in the tappet/roller follower mounting hole when the cylinder head is oriented as installed on the engine in vehicle position is defined by the height of the dam.

7. The cylinder head of claim 1, wherein the tappet/roller follower is one of a tappet, a tappet/roller follower and a roller follower.

8. A method for providing lubrication to a fuel pump tappet/roller follower orifice in a cylinder head configured to include a tappet/roller follower mounted in the fuel pump tappet/roller follower orifice, the tappet/roller follower in communication with a cam and a fuel pump, the method comprising:

forming a dam defining a reservoir in the cylinder head;

providing lubricant to the tappet/roller follower orifice;

retaining lubricant in the reservoir using the dam;

wherein by retaining lubricant in the reservoir, lubricant is retained in the tappet/roller follower orifice and provided to a sliding interface between the tappet/roller follower and a surface of the tappet/roller follower orifice; and draining lubricant from the tappet/roller follower orifice over the dam such that lubricant does not accumulate above a predetermined level in the tapper/roller follower orifice.

9. The method of claim 8, wherein forming the dam defining the reservoir further comprises:

forming the dam in a cast body of the cylinder head.

10. The method of claim 8, wherein forming the dam defining the reservoir further comprises:

machining the dam in the body of the cylinder head.

11. The method of claim 8, wherein providing lubricant to the tappet/roller follower orifice further comprises:

directing oil from an adjacent cam bearing onto the tappet/roller follower; and wherein oil directed onto the tappet/roller follower flows into one of the tappet/roller follower orifice and reservoir.

12. The method of claim 8, wherein retaining lubricant in the reservoir using the dam further includes retaining the lubricant at up to a specified level in the tappet/roller follower mounting orifice when the cylinder head is oriented in vehicle position.

13. The method of claim 8, further comprising:

providing a drainage passage in the cylinder head configured to drain lubricant from the tappet/roller follower orifice such that lubricant does not accumulate above a predetermined level in the tapper/roller follower orifice.

* * * * *